US005181632A

United States Patent [19]

Latter

[11] Patent Number: 5,181,632

[45] Date of Patent: Jan. 26, 1993

[54] DISPENSER CAP HAVING TAMPER-EVIDENT FEATURES

[75] Inventor: David L. Latter, Glendale, Calif.

[73] Assignee: Morehouse Foods, Inc., Los Angeles, Calif.

[21] Appl. No.: 745,553

[22] Filed: Aug. 15, 1991

[51] Int. Cl.[5] ..... B67B 5/00

[52] U.S. Cl. ..... 222/153; 222/521; 222/541; 206/497; 215/246; 215/274

[58] Field of Search ..... 222/153, 541, 521; 215/250, 246, 252, 274; 292/256.61; 206/497

[56] References Cited

U.S. PATENT DOCUMENTS

| | | | |
|---|---|---|---|
| 4,538,740 | 9/1985 | Petersen, Jr. | 215/246 |
| 4,570,825 | 2/1986 | Stull | 222/521 X |
| 4,646,949 | 3/1987 | Stull | 222/521 |
| 4,745,899 | 7/1988 | Stull | 222/521 |
| 4,773,572 | 9/1988 | Stull | 222/521 |
| 5,046,646 | 9/1991 | Stull | 215/252 X |
| 5,088,613 | 2/1992 | Dutt et al. | 222/521 X |
| 5,111,947 | 5/1992 | Patterson | 215/252 X |

FOREIGN PATENT DOCUMENTS

| | | | |
|---|---|---|---|
| 2098969 | 12/1982 | United Kingdom | 222/521 |

*Primary Examiner*—Gregory L. Huson
*Attorney, Agent, or Firm*—Cislo & Thomas

[57] ABSTRACT

A twist-on/twist-off dispenser cap, of a type normally used for dispensing mustard or ketchup, comprises a bottom cap portion which screws onto a cooperating container and a generally cone-shaped spout portion which is captively held by a screw-type arrangement on the bottom cap portion. Rotation of the spout portion with respect to the bottom cap portion allows an orifice at the tip of the spout portion to be either opened or closed. A relatively wide annular flange at the base of the spout portion fits into a corresponding shallow recess in the top of the bottom portion of the dispenser cap. The flange and a plurality of spaced circumferential ridges at the periphery of the flange allow excellent gripping of a shrink-wrap seal to make the dispenser cap tamper-proof. The container onto which the dispensing cap is screwed has a circumferential collar adjacent a threaded neck portion. Two series of notches on opposing sides of the collar define intervening protuberances. The notched collar affords secure gripping by a shrink-wrap seal to hold the cap portion to the container in a tamper-proof manner.

17 Claims, 3 Drawing Sheets

DISPENSER CAP HAVING TAMPER-EVIDENT FEATURES

BACKGROUND OF THE INVENTION

This invention relates to a dispenser-type cap for use on ketchup or mustard containers or the like. In particular, the invention relates to a dispenser cap having tamper-evident features, and a container for use with the cap.

At present various types of food condiments are packaged and sold in containers having dispenser caps which allow small amounts of the condiment to be released by adjusting the cap from a first, closed position to a second, open position. With the cap in an open position the container is inverted and/or squeezed to release a desired amount of the contents.

In recent years there have been an increasing number of incidents involving the tampering with of the contents of products for use on or in the human body while the products are on the shelves of retail stores. Examples include the introduction of cyanide into headache remedy capsules and the introduction of caustic solutions into eyedrop bottles.

The prospects seem dim at best for improving the general mental health of the human race to the point where such incidents vanish. A more practical approach to the problem, which has been widely implemented with respect to over-the-counter drugs and eyecare products, is to provide a cap for the product container which displays evidence of having been tampered with.

The consumer is protected from possible injury or death by refusing to purchase any product with a container that appears to have been tampered with. The consequent losses associated with the tampering of product containers by deranged or cold-blooded individuals is thus limited to the economic losses of the merchant who discards products that show evidence of having been tampered with.

The following patents may have some relevance to the present invention:

| U.S. Pat. No. | Name of Inventor | Date Issued |
|---|---|---|
| 960,898 | J. Gullong | June 7, 1990 |
| 1,009,536 | J. F. Lokowich | November 21, 1911 |
| 1,756,165 | E. R. Petrie | April 29, 1930 |
| 2,734,665 | K. H. Flamm | February 14, 1956 |
| 3,149,763 | N. T. Exton | September 22, 1964 |
| 3,486,503 | A. J. Porter et al. | December 30, 1969 |
| 3,570,726 | Pomodoro | March 16, 1971 |
| 3,581,953 | Donoghue | June 1, 1971 |
| 4,223,810 | Sneider | September 23, 1980 |
| 4,240,566 | Bergman | December 23, 1980 |
| 4,432,496 | Ito | February 21, 1984 |
| 4,572,386 | Marcus | February 25, 1986 |
| 4,487,336 | Sneider | December 11, 1984 |
| 4,946,075 | Lundbaeck | August 7, 1990 |
| 4,957,225 | Childers | September 18, 1990 |

Reference to the above listed patents will show that there are varying degrees of relevance to the present invention. Brief descriptions of some of the more pertinent of the patents are given below.

U.S. Pat. No. 4,240,566 to Bergman is directed to a cap and mixing cup arrangement for a multiple-chamber container. The container 10 includes a removable collar 116 having a central threaded aperture, and a cap 100 having a threaded lower body which threadably engages the threaded central aperture of collar 116.

U.S. Pat. No. 4,432,496 to Ito is directed to a foam liquid dispensing device. The liquid dispensing device includes a cylindrical container 10 having a threaded neck 11, an inner cover which threadably engages neck 11, and an outer cover member 40 which threadably engages an outwardly extending outer cylindrical portion 27 of cover 20. Neck cover 20 includes an inner cylindrical portion 22 which tapers outwardly to provide a frustoconical portion 23. Outer cover 40 includes a jet nozzle 42 at its uppermost end.

None of the patents listed in the table above is any more relevant than those that have been briefly described. Two examples of prior-art dispenser containers are depicted in FIGS. 7–10 of the drawing.

There has existed a long-felt need for a tamper-proof or tamper-evident type of dispenser cap for edible products such as ketchup, mustard, honey, or the like. Ideally such a dispenser cap would operate in a manner similar to the dispenser caps now on the market, but be amenable to safety sealing, so that any unauthorized opening and closing of the cap prior to sale would be immediately apparent to a prospective purchaser.

SUMMARY OF THE INVENTION

In accordance with the present invention, a dispenser cap having tamper-evident features comprises a spout portion and a cap portion. The cap portion has a central cylindrical tube with external threads rising from a flat annular depression in the upper surface of a generally cylindrical open-bottomed screw-on cap.

The outer periphery of the cap portion has a multitude of transverse spaced ridges to give a knurled appearance and provide a better grip for screwing or unscrewing the cap onto a container. The central threaded tube on the upper part of the cap portion is connected to a distal rod-like plug by means of four thin and narrow struts with intervening generally triangular spaces between them.

The spout portion comprises an annular flange from which rises a hollow frustoconical tip with a plurality of ridges running along the outer surface of the tip from the flange toward a distal open end of the tip. The interior wall of the frustoconical tip near the annular flange has threads to match the threads on the central tube of the cap portion.

At the periphery of the annular flange on its upper surface are a plurality of spaced-apart ridges consisting of raised circular segments. The relatively wide annular flange fits into the corresponding annular depression in the top of the cap portion with its ridged outer periphery extending above the rim of the depression when the dispenser cap is in a closed configuration.

The invention further encompasses a container that cooperates with the dispenser cap and is designed to provide an optimum shrink-wrap sealing arrangement. Besides having external threads on a neck portion near the mouth of the container which match the internal threads of the cap portion, the cooperating container has a collar portion proximally adjacent the threads with a series of notches on opposite sides of the collar. The collar and opposed sets of notches provide excellent gripping surfaces for a shrinkwrap seal when the dispenser cap is screwed onto the container.

The generous width of the annular flange in combination with the raised ridges along the outer circumference of the flange, as well as the collar portion on the container neck with the notches on opposite sides of the collar allow a shrink-wrap material to be applied that provides a tamper-evident seal of the dispenser cap to the container on which the cap is screwed. The dispenser cap and cooperating container of the present invention when shrink-wrapped tightly together comprise a tamper-proof seal. The dispenser cap cannot be manipulated into an open configuration without mutilating or destroying the shrink-wrap seal holding the cap to its associated container.

Further objects and advantages of the present invention will become apparent from a consideration of the drawings and the ensuing description, in which like reference numerals refer to like parts.

DETAILED DESCRIPTION O THE PREFERRED EMBODIMENT

FIGS. 7–10 show two typical prior-art dispenser caps which because of their design are not good candidates for a tamper-proof shrink-wrap seal. As shown in the upper part of FIG. 7, the base of the frustoconical spout consists of a narrow circular rim which does not provide an effective surface for shrink-wrapping to grip. A shrink-wrap layer would cover mostly the flat top of the cap portion shown in the lower part of FIG. 7, with a poor restraining grip on the curved, steeply inclined sides of the frustoconical spout.

Figure 9:
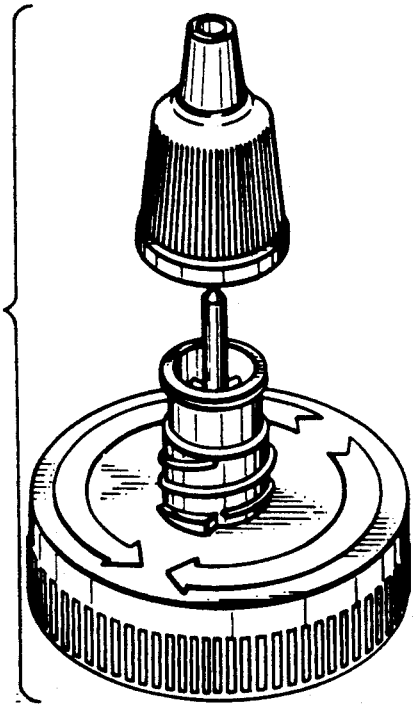
Fig. 9 (PRIOR ART)
FIG. 9 is an exploded perspective view of a second prior-art dispenser cap.
Figure 8:
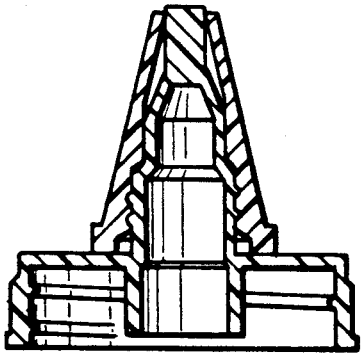
Fig. 8. (PRIOR ART)
FIG. 8 is a central cross-sectional view of an assembled prior-art dispenser cap of the type shown in FIG. 7.
Figure 10:
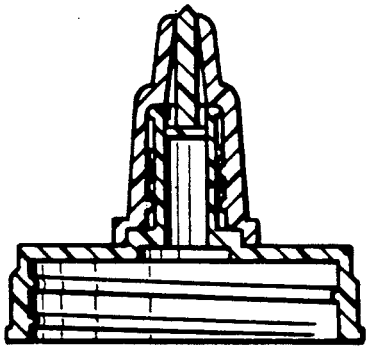
Fig. 10. (PRIOR ART)
FIG. 10 is a central cross-sectional view of an assembled prior-art dispenser cap of the type shown in FIG. 9.

Similarly, with the prior-art dispenser cap shown in FIG. 9, the central screw-on tip affords very little effective gripping surface area for a shrink-wrap seal. Again, a shrink-wrap covering would serve mostly to hold the cap part of the dispenser to its associated container. Restraint of the curved, steeply sloping central tip would be nonexistent or ineffectual at best.

Figure 1:
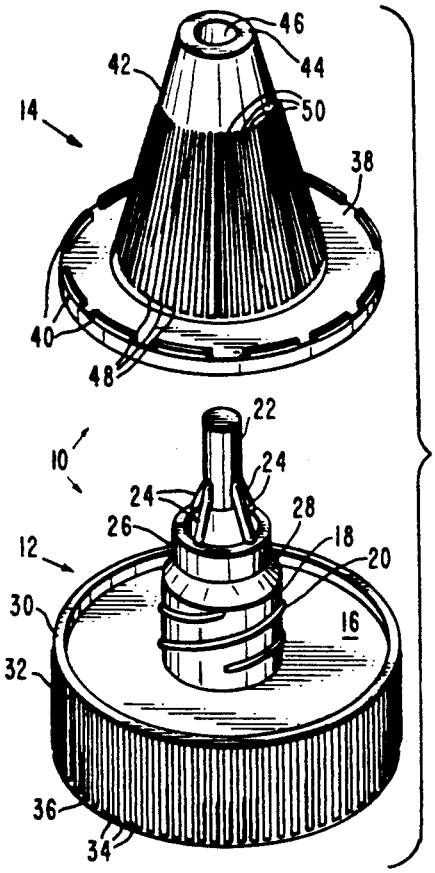
FIG. 1 is an exploded perspective view of the dispenser cap of the present invention.

The present invention cures the deficiencies in the prior-art. Referring to FIG. 1, a dispenser cap 10 in accordance with the present invention comprises a screw-on cap portion 12 and a spout portion 14. An upper surface of cap portion 12 includes an annular depression 16 surrounding a generally tubular central column portion 18 bearing raised threads 20. Column portion 18 ends in a rod-like plug 22 connected by thin struts 24 to a cylindrical endpiece 26. Endpiece 26 is connected by a sloping shoulder 28 to column portion 18.

Annular depression 16 is surrounded by a raised upper rim 30 which is contiguous with a circumferential surface 32, on which a large number of spaced parallel ridges 34 run from upper rim 30 to a lower rim 36 of cap portion 12.

Spout portion 14 comprises an annular flange 38 having a series of spaced-apart ridged circular segments 40 on an outer periphery thereof. A central frustoconical hollow tip 42 rises from annular flange 38 and terminates in a flat end 44 having an opening 46. The lower part of tip 42 has a large number of raised straight line segments 48 defining intervening linear grooves 50 therebetween.

Figure 2:
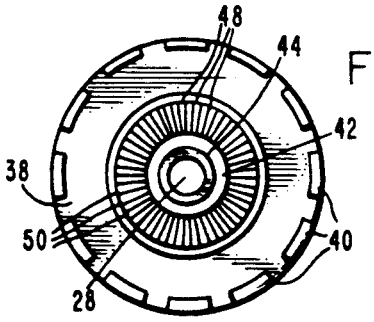
FIG. 2 is a top plan view of the spout portion shown in the upper part of FIG. 1.
Figure 3:
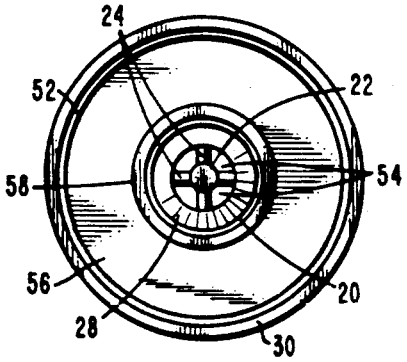
FIG. 3 is a bottom plan view of the cap portion shown in the lower part of FIG. 1.

FIG. 2 shows a top view of spout portion 14. FIG. 3 is a bottom plan view of cap portion 12 of dispenser cap 10. An interior wall of cap portion 12 contains threads 52 which fit corresponding external threads on the container onto which dispenser cap 10 is screwed.

As can be seen clearly from FIG. 3, narrow struts 24 are spaced about 90 degrees apart to define intervening spaces 54 through which the contents of the container can be dispensed. Flat annular portion 56 is the underside of annular depression 16 and surrounds a tube segment 58. Tube segment 58 is an extension of tubular column 18 beyond the level of annular portion 56.

Figure 4:
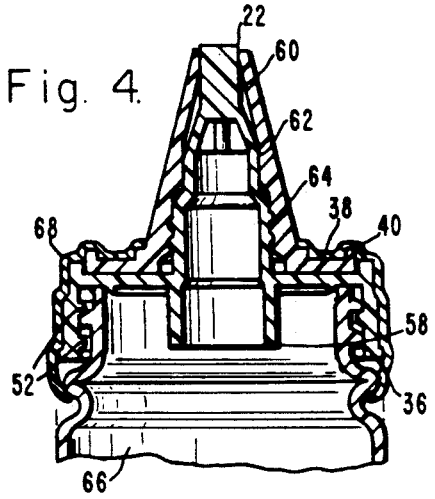
FIG. 4 is a central cross-sectional view of an assembled dispenser cap screwed onto the top of a container, with shrink wrapping holding the dispenser cap in its closed configuration and preventing unscrewing of the cap from its container.

Additional details of the construction of dispenser cap 10 can be seen in FIG. 4, which is a central sectional view of dispenser cap 10 in its closed configuration. Near opening 46 of spout portion 14 is an inner frustoconical surface 60 terminating proximally in a straight vertical annular inner surface 62. Surface 62 sealingly abuts outer surface 26 of cap portion 12. Inner threads 64 inside spout portion 14 cooperate with outer threads 20 on cylindrical column portion 18 of cap portion 12.

Referring still to FIG. 4, dispenser cap 10 is shown screwed onto a top portion of a container 66 shown in phantom outline. Container 66 is designed to cooperate with dispenser cap 10 and forms part of the present invention. A shrink-wrap seal 68 extends from just below lower rim 36 of cap portion 12 to just beyond the inner limit of annular depression 38. Shrink-wrap seal 68 must be broken or damaged in order to unscrew cap portion 12 from container 66 or to unscrew spout portion 14 into its dispensing configuration.

In particular, seal 68 is drawn tightly against annular flange 38 and the plurality of ridged circular segments 40 to secure spout portion 14 in its closed configuration against cap portion 12. A comparison with FIGS. 7–10 showing prior-art dispenser caps emphasizes the advantages of the present invention in this respect.

Figure 5:
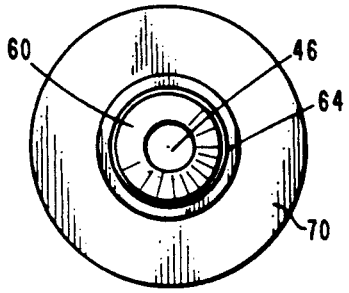
FIG. 5 is a bottom plan view of the spout portion shown in the upper part of FIG. 1.

FIG. 5 is a bottom plan view of spout portion 14. Adjacent to opening 46 is inner frustoconical surface 60 There are threads 64 on the interior surface of frustoconical tip 42 near an underside 70 of annular flange 38. Threads 64 mate with threads 20 on column portion 18 of cap portion 12.

Figure 6:
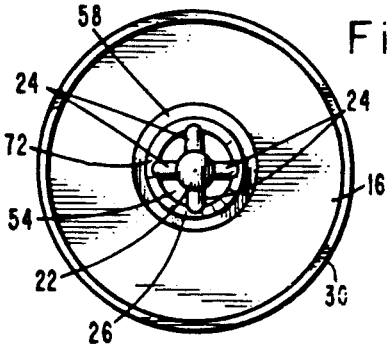
FIG. 6 is a top plan view of the cap portion shown in the lower part of FIG. 1.
Figure 7:
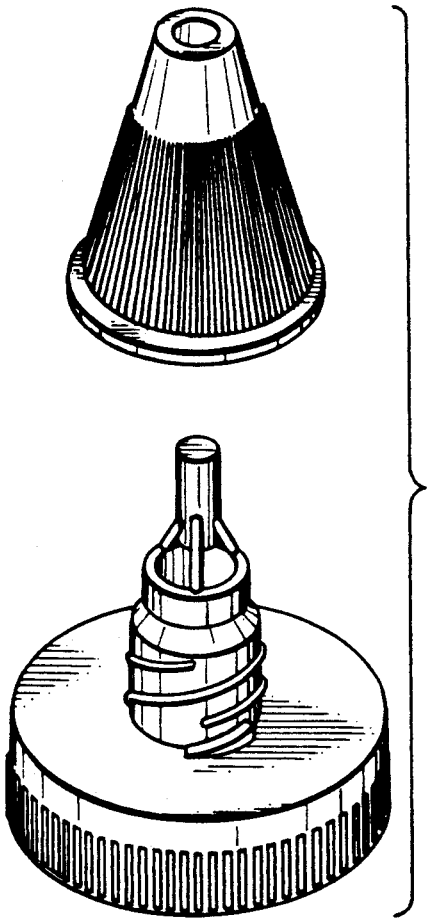
Fig. 7 (PRIOR ART)
FIG. 7 is an exploded perspective view of a first prior-art dispenser cap.

Referring now to FIG. 6, which is a top plan view of cap portion 12, rod-like plug 22 is supported by four struts 24 connected to an annular end surface 72 of cylindrical end piece 26. When dispenser cap 10 is in its closed configuration, plug 22 occludes opening 46 in tip 42 of spout portion 14

When spout portion 14 is unscrewed relative to cap portion 12, a cylindrical passageway appears between the outer curved surface of plug 22 and the inner wall of frustoconical tip 60 near opening 46. In this configuration, material from container 66 can flow through spaces 54 and around plug 22 through opening 46 when container 66 is inverted and/or squeezed.

Figure 11:
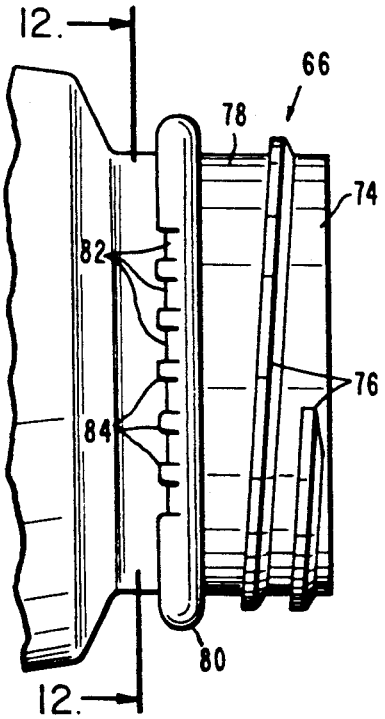
FIG. 11 is a fragmentary side elevational view of the cooperating container of the present invention.
Figure 12:
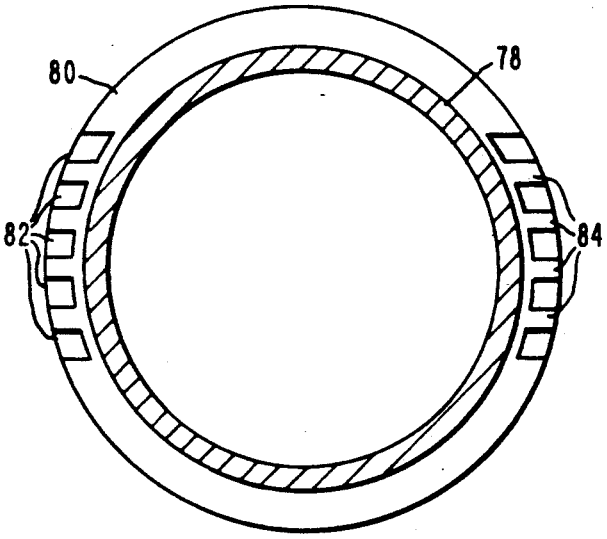
FIG. 12 is a cross-sectional view of the container as indicated in FIG. 4.

Referring to FIG. 11, the upper part of container 66 is shown in a side view. A cylindrical open mouth portion 74 has threads 76 which match threads 52 on the interior wall of cap portion 12. A neck portion 78 of container 66 adjacent threads 76 has a circumferential collar or lip 80. A series of notches 82 in collar 80 on opposite sides of neck portion 78 create a series of protuberances 84. The arrangement of notches 82 in lip 80 is shown more clearly in FIG. 12.

The combination of collar 80 with its dual arrangement of notches 82 and intervening protuberances 84 provides surfaces for excellent gripping by a shrink-wrap covering. Referring again to FIG. 4, shrink-wrap seal 68 completely covers collar 80 on neck portion 78 of container 66 to provide tamper-proof closure. In particular, shrink-wrap seal 68 will stretch tightly across protuberances 84 and be held in notches 82 on opposite sides of collar 80 to prevent any loosening of cap portion 12 from container 66 absent mutilation or destruction of shrink-wrap seal 68.

Component parts 12 and 14 of dispenser cap 10 are preferably made from a suitable plastic material and can be manufactured by an inexpensive molding process. Shrink-wrap seal 68 can be applied to dispenser cap 10 on container 66 using methods and materials which are well known in the art.

It should be understood that the invention in its broader aspects is not limited to the specific embodiment shown and described herein, but departures may be made therefrom within the scope of the appended claims without departing from the principles of the invention and without sacrificing its chief advantages. For example, details of the construction of column portion 12 and the interior of spout portion 14 can be varied without affecting the tamper-evident feature of the present dispenser cap 10. All such modifications and changes will make themselves apparent to those of ordinary skill in the art and all such changes and modifications are intended to be covered by the appended claims.

I claim:

1. A dispenser cap adapted for tamper-proof sealing to a container, comprising:

a spout portion having an annular flange defining a series of spaced-apart, ridged circular segments on an outer periphery at a first end, said flange extending away from and surrounding a central tip, having a second end with a first opening therein communicating with a central passage terminating in a second opening in said first end, said passage having an internal wall with means thereon for altering a relative position of said spout portion with respect to a screw-on container cap; said screw-on container cap having internal threads to match external threads on a container neck, said container cap having, on an upper surface thereof, an intention complementary in shape to said flange and surrounding a central column portion having a shape to cooperate with said means for altering said relative position, said container having an outer peripheral cylindrical surface comprising a plurality of spaced parallel ridges, said column means terminating in a plug means for occluding said first opening in said second end of said spout portion when said spout portion and said container cap are in a fist relative configuration, and orifice means proximally adjacent said plug means, said orifice means for allowing a clear passage from a central hollow interior of aid column portion through said opening in said second send of said spout portion when said spout portion and said container cap are in a second relative configuration.

2. The dispenser cap of claim 1 wherein aid means for altering comprises screw threads and said central column portion has mating screw threads thereon.

3. The dispenser cap of claim 1 wherein a distal end of said plug means and an interior wall of said central tip adjacent said first opening in said second end comprise complementary shapes.

4. The dispenser cap of claim 1 wherein aid container cap further comprise a cylindrical tube coaxial with said central column portion and extending in an opposite direction thereto.

5. The dispenser cap of claim 1 wherein said central tip comprises a frustoconical tube having an outer surface with a plurality of parallel ridged lines running from said flange toward said distal end of said tip.

6. The combination of a dispenser cap according to claim 1 with a shrink-wrap seal covering said container cap and said flange when said container cap is screwed onto a container and is in a closed configuration, wherein said dispenser cap becomes tamper-proof.

7. The combination of a dispenser cap according to claim 1 with a container comprising:

an open mouth portion and an adjoining neck portion having external threads thereon to match said internal threads of said container cap; and a collar on said neck portion proximally adjacent said external threads and having first and second pluralities of spaced-apart notches therein on opposite sides of said neck portion.

8. The dispenser cap and container of claim 7 further comprising a shrink-wrap seal covering said container cap and said flange of said dispenser cap and also covering said collar on said neck portion of said container when said container cap is screwed onto said container and is in a closed configuration, wherein the combination of said dispenser cap on said container becomes tamper-proof.

9. A dispenser cap for securement to a container by a tamper-proof or tamper-evident seal, comprising:

a cap portion including a generally cylindrical, hollow cap with internal screw threads inside a lower cylindrical portion thereof, a flat annular depression in a top surface of said cap surrounded by a raised circular rim, and a central column portion surrounded by said annular depression, said column portion having external screw threads and a central passageway communicating with an interior of said hollow cap, and a plug attached to a distal end of said column portion by a plurality of thin struts defining intervening spaces therebetween;

a spout portion including an annular flange sized to fit said annular depression in said cap, said flange surrounding a hollow frustoconical tip having an opening in a distal end thereof, said flange further including a plurality of spaced-apart ridged circular segments on an upper surface at an outer periphery thereof, an inner wall of said tip near said flange having mating threads to accommodate said external threads on said central column portion of said cap portion; and wherein said spout portion can be screwed in a first direction until a bottom surface of said annular flange is tightened against said annular depression in said cap portion and said plug occludes said opening in said tip in a first configuration of said dispenser cap, and wherein said spout portion can be unscrewed in a direction opposite said first direction to create a passageway through said central column portion and around said plug and through said opening in said distal end of said tip in a second configuration of said dispenser cap.

10. The dispenser cap of claim 9 wherein an outer peripheral cylindrical surface of said cap portion further comprises a plurality of parallel ridged lines thereon.

11. The dispenser cap of claim 9 wherein said frustoconical tip further comprises a plurality of parallel ridged lines running from said flange toward said distal end of said tip.

12. The dispenser cap of claim 9 wherein a distal end of said plug and an interior wall of said tip adjacent said opening in said distal end comprise complementary shapes.

13. The dispenser cap of claim 9 wherein said cap portion further comprises a cylindrical tube coaxial with said central column portion and extending in an opposite direction thereto.

14. The dispenser cap of claim 9 wherein said cap portion and said spout portion each comprise a plastic material.

15. The combination of a dispenser cap according to claim 9 with a shrink-wrap seal covering said cap portion and said annular flange when said dispenser cap is screwed onto a container and is in said first configuration, wherein said dispenser cap becomes tamper-proof.

16. The combination of a dispenser cap according to claim 9 with a container comprising:

an open mouth portion and an adjoining neck portion having external threads thereon to match said internal threads of said container cap; and a collar on said neck portion proximally adjacent said external threads and having first and second pluralities of spaced-apart notches therein on opposite sides of said neck portion.

17. The dispenser cap and container of claim 16 further comprising a shrink-wrap seal covering said container cap and said flange of said dispenser cap and also covering said collar on said neck portion of said container when said container cap is screwed onto said container and is in a closed configuration, wherein the combination of said dispenser cap on said container becomes tamper-proof.

* * * * *